US006681658B1

(12) United States Patent
O'Neal et al.

(10) Patent No.: US 6,681,658 B1
(45) Date of Patent: Jan. 27, 2004

(54) ROOF-REMOVING SHOVEL APPARATUS

(76) Inventors: Shonada D. O'Neal, 2640 Lyles La., Shreveport, LA (US) 71118; Leon B. O'Neal, 2640 Lyles La., Shreveport, LA (US) 71118

( * ) Notice: Subject to any disclaimer, the term of this patent is extended or adjusted under 35 U.S.C. 154(b) by 0 days.

(21) Appl. No.: 10/120,595

(22) Filed: Apr. 15, 2002

(51) Int. Cl.[7] ..... E04D 15/02
(52) U.S. Cl. ..... 81/45; 294/49; 30/169
(58) Field of Search ..... 294/49, 55, 59; 81/45; 30/167, 169

(56) References Cited

U.S. PATENT DOCUMENTS 1,351,425 A * 8/1920 Kaney ..... 294/49
2,211,741 A * 8/1940 Elwell ..... 74/56
3,818,593 A * 6/1974 Oilverius ..... 30/169
4,466,188 A * 8/1984 Svendsgaard ..... 30/172
4,663,995 A * 5/1987 Amundson et al. ..... 81/45
4,756,578 A * 7/1988 Mims et al. ..... 299/37.1
4,858,503 A * 8/1989 Dike, Jr. ..... 81/45
5,009,131 A * 4/1991 Alto et al. ..... 81/45
D353,978 S * 1/1995 Sargeant ..... D8/10
5,921,155 A * 7/1999 Faller et al. ..... 81/45
6,105,470 A * 8/2000 Hutchins ..... 81/45
6,128,979 A * 10/2000 Shepherd ..... 81/45

* cited by examiner

*Primary Examiner*—Dean J. Kramer

(57) ABSTRACT

A roof-removing shovel apparatus for removing old shingles and other roofing material from building structures. The roof-removing shovel apparatus includes a scoop member including a main wall having a bottom edge, and also including side and top walls attached to the main wall; and also includes a blade member being attached along the bottom edge of the main wall of the scoop member; and further includes a shaft assembly including a support member being attached to the top wall of the scoop member; and also includes a handle member being mounted to the shaft assembly for controlling the scoop member; and further includes an assembly for oscillating the scoop member to effect chiseling of roof material.

6 Claims, 4 Drawing Sheets

ROOF-REMOVING SHOVEL APPARATUS

BACKGROUND OF THE INVENTION

1. Field of the Invention

The present invention relates to roof material removal tools a and more particularly pertains to a new roof-removing shovel apparatus for removing old shingles and other roofing material from building structures.

2. Description of the Prior Art

The use of roof material removal tools is known in the prior art. More specifically, roof material removal tools heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,906,145; U.S. Pat. No. 6,105,470; U.S. Pat. No. 6,128,979; U.S. Pat. No. 5,009,131; U.S. Pat. No. 5,836,222; and U.S. Pat. No. Des. 324,633.

While these devices fulfill their respective, particular objectives and requirements, the aforementioned patents do not disclose a new roof-removing shovel apparatus. The prior art describes inventions having scoop members connected to shafts.

SUMMARY OF THE INVENTION

The general purpose of the present invention, which will be described subsequently in greater detail, is to provide a new roof-removing shovel apparatus which has many of the advantages of the roof material removal tools mentioned heretofore and many novel features that result in a new roof-removing shovel apparatus which is not anticipated, rendered obvious, suggested, or even implied by any of the prior art roof material removal tools, either alone or in any combination thereof. The present invention includes a scoop member including a main wall having a bottom edge, and also including side and top walls attached to the main wall; and also includes a blade member being attached along the bottom edge of the main wall of the scoop member; and further includes a shaft assembly including a support member being attached to the top wall of the scoop member; and also includes a handle member being mounted to the shaft assembly for controlling the scoop member; and further includes an assembly for oscillating the scoop member to effect chiseling of roof material.

There has thus been outlined, rather broadly, the more important features of the roof-removing shovel apparatus in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new roof-removing shovel apparatus which has many of the advantages of the roof material removal tools mentioned heretofore and many novel features that result in a new roof-removing shovel apparatus which is not anticipated, rendered obvious, suggested, or even implied by any of the prior art roof material removal tools, either alone or in any combination thereof.

Still another object of the present invention is to provide a new roof-removing shovel apparatus for removing old shingles and other roofing material from building structures.

Still yet another object of the present invention is to provide a new roof-removing shovel apparatus that is easy and convenient to use on roof tops.

Even still another object of the present invention is to provide a new roof-removing shovel apparatus that speeds up the process of removing the roofing material thus increasing productivity and also reduces the possibility of injury to the user.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
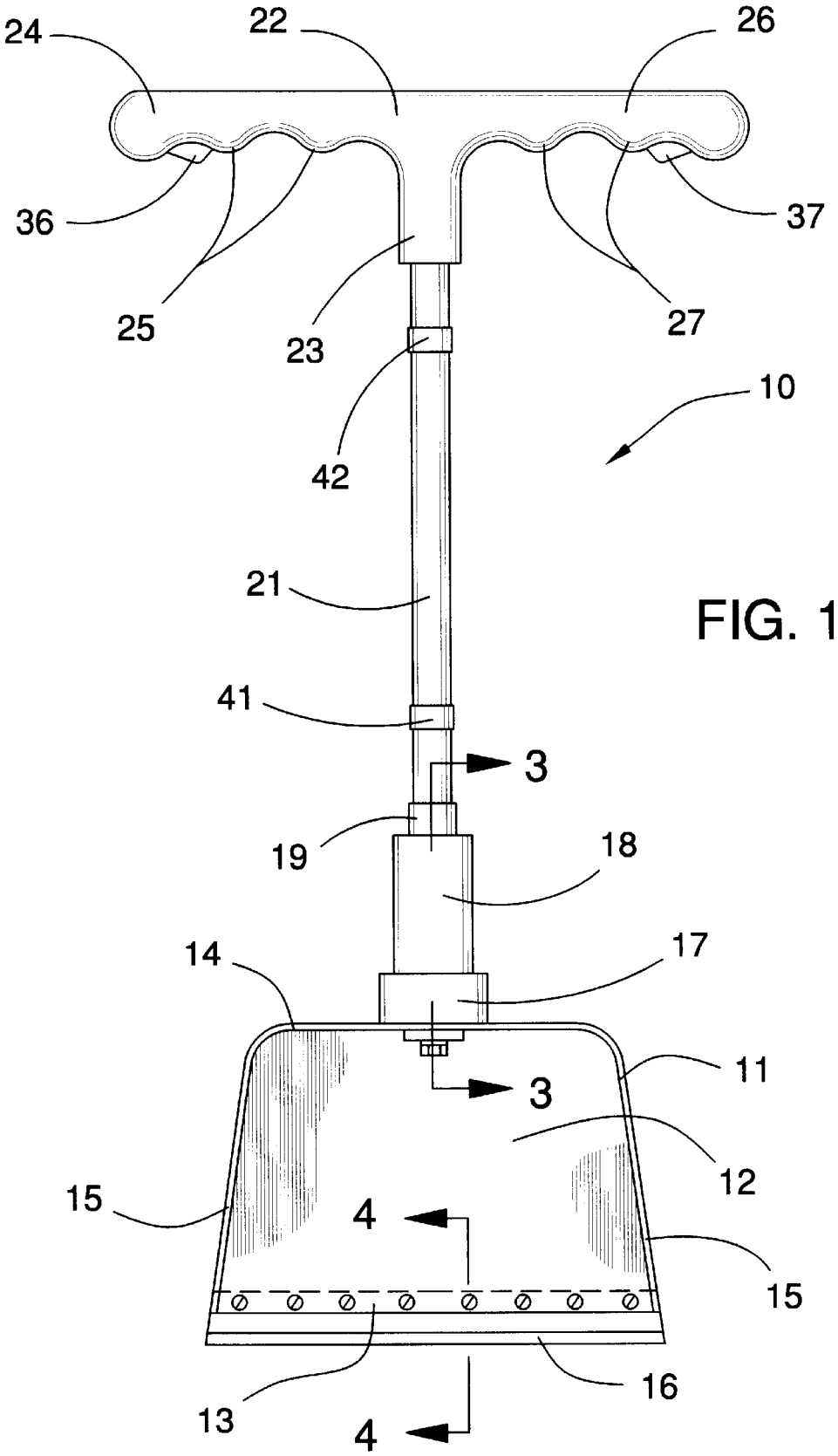
FIG. 1 is a front elevational view of a new roof-removing a shovel apparatus according to the present invention.
Figure 2:
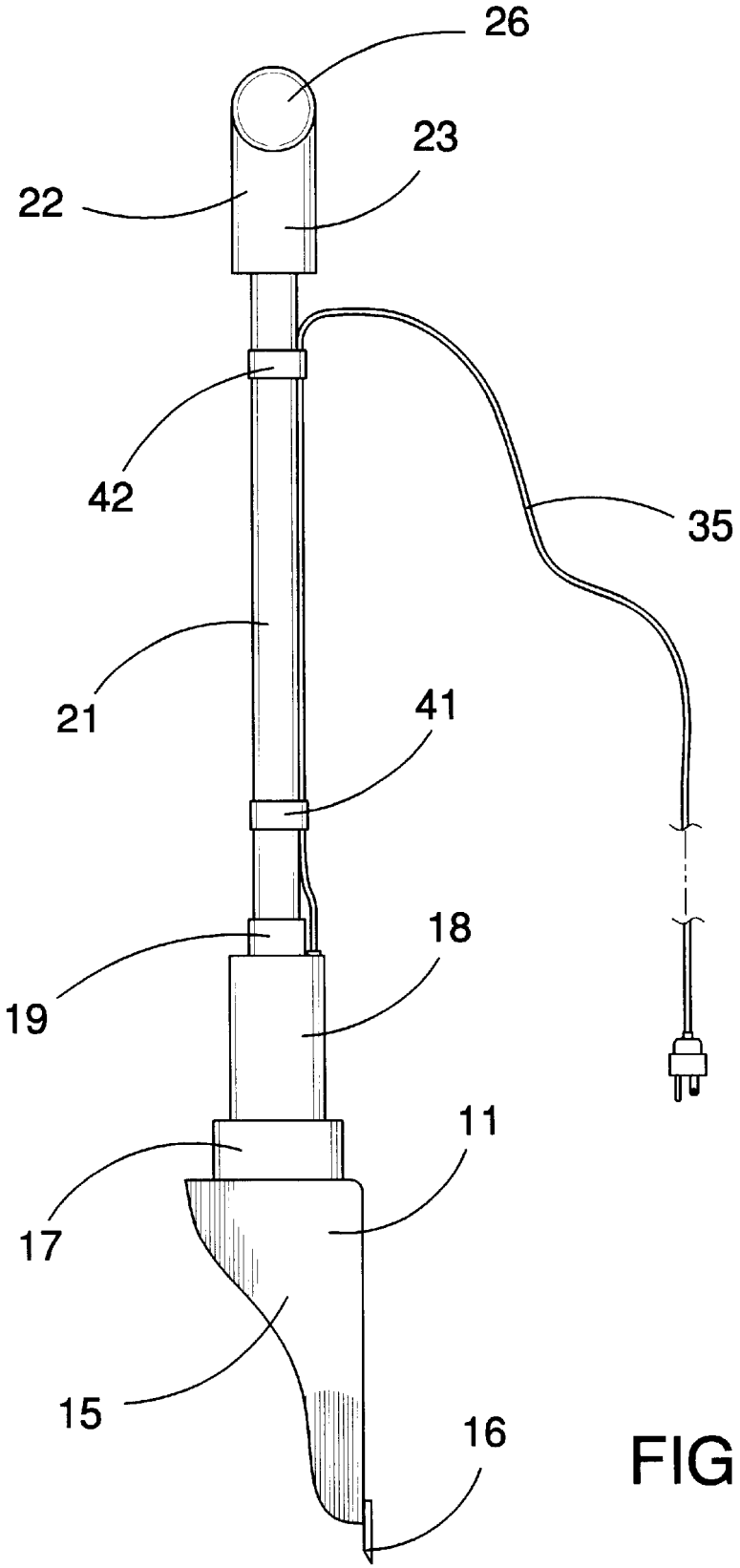
FIG. 2 is a side view of the present invention.
Figure 3:
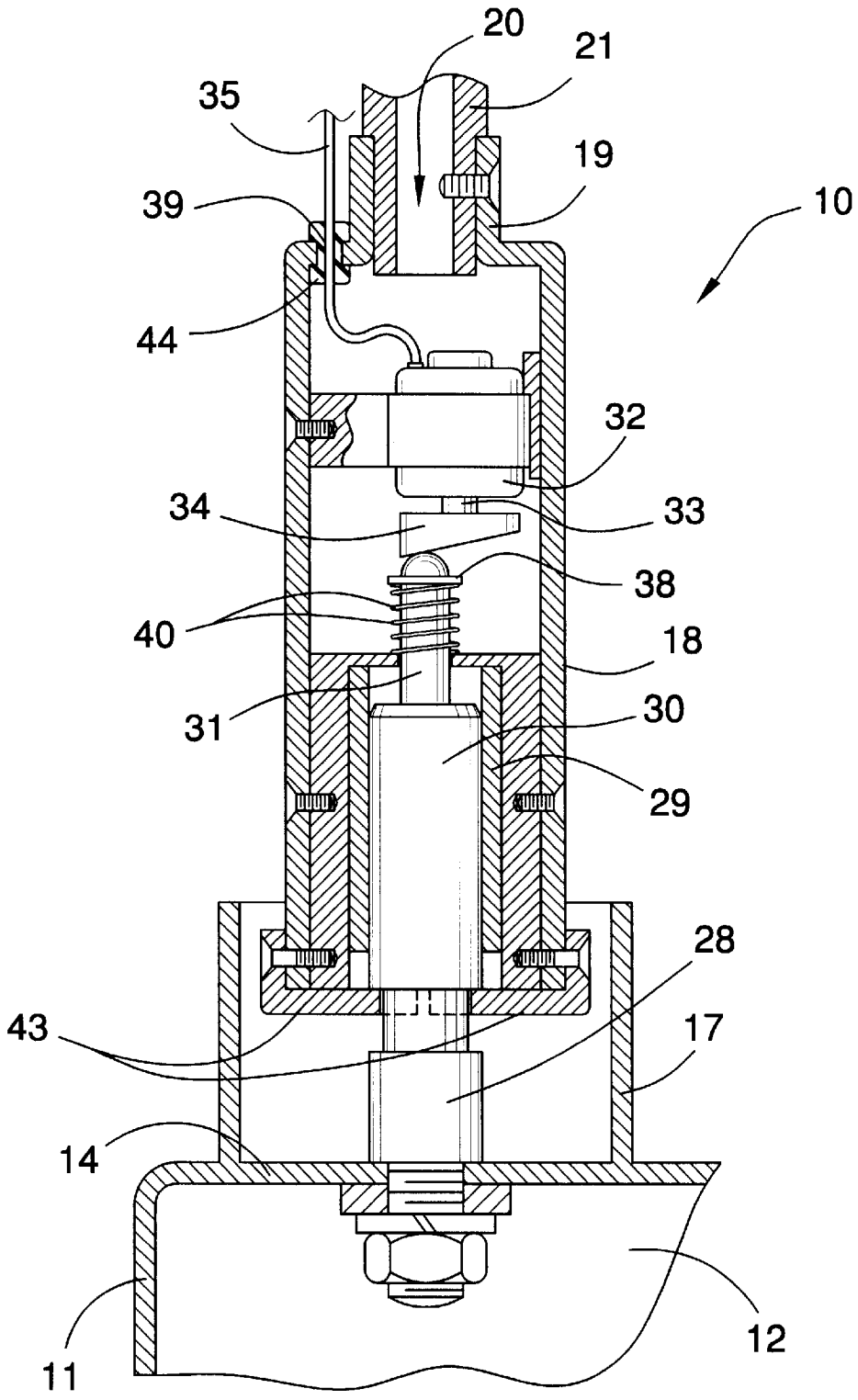
FIG. 3 is a partial cross-sectional view of the present invention.
Figure 4:
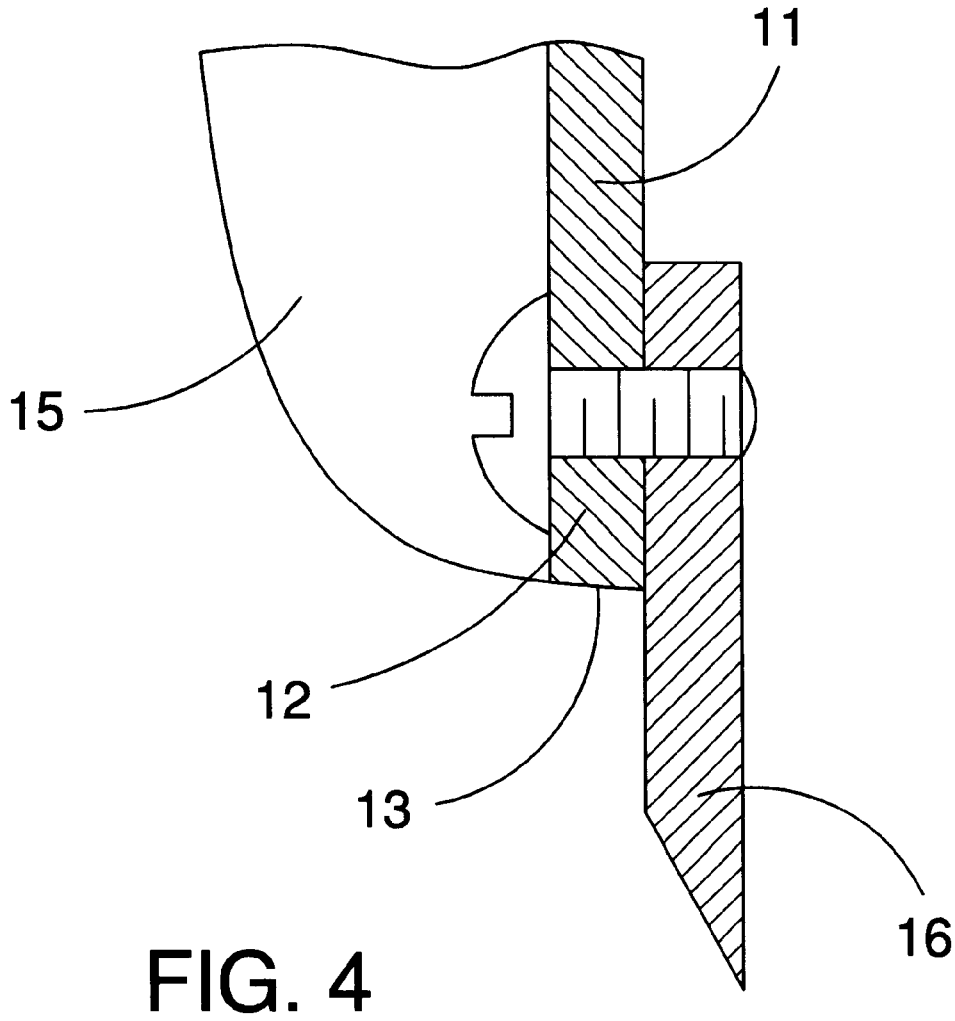
FIG. 4 is a partial cross-sectional view of the blade member of the present invention.

With reference now to the drawings, and in particular to FIGS. 1 through 4 thereof, a new roof-removing shovel apparatus embodying the principles and concepts of the present invention and generally designated by the reference numeral 10 will be described.

As best illustrated in FIGS. 1 through 4, the roof-removing shovel apparatus 10 generally comprises a scoop member 11 including a main wall 12 having a bottom edge 13, and also including side and top walls 14,15 conventionally attached to the main wall 12. The top wall 14 extends outwardly along a top edge of the main wall 12, and the side walls 15 extend outwardly along side edges of the main wall 12. Each of the side walls 15 has a sinusoidal outer edge. A blade member 16 is attached with bolts along the bottom edge 13 of the main wall 12 of the scoop member 11. The blade member 16 is made of high carbon steel.

A shaft assembly includes a support member 17 being conventionally attached to the top wall 14 of the scoop member 11. The shaft assembly also includes a housing member 18 being extended from the support member 17, and also includes an elongate shaft member 21 being fastened with fasteners to the housing member 18 and extending outwardly therefrom, and further includes housing supports 43 being securely and conventionally disposed in the support member 17. The housing member 18 has a boss extension portion 19 at a top end thereof and also has an opening 20 extending through the boss extension portion 19 into the housing member 18. The elongate shaft member 21 has a bottom portion which is extended into the opening 20 and fastened with a fastener in the boss extension portion 19.

A handle member 22 is conventionally mounted to the shaft assembly for controlling the scoop member 11. The handle member 22 includes a tubular portion 23 being securely mounted upon a top end of the elongate shaft member 21, and also includes extended grip portions 24,26 extends outwardly from the tubular portion 23 with the handle member 22 being generally T-shaped. Each of the extended grip portions 24,26 has an undulating bottom side 25,27 for facilitating gripping of the extended grip portions 24,26.

A means for oscillating the scoop member to effect chiseling of roof material includes a vibratable shaft 28 being conventionally disposed in the support member 17 and being securely attached with a fastener to the top wall 14 of the scoop member 11, and also includes a bushing 29 being securely and conventionally disposed in the housing member 18, and further includes a piston support member 30 having open ends and being conventionally supported by the bushing 29, and also includes a piston 31 being movably extended through the piston support member 30 and being in contactable relationship to the vibratable shaft 28, and further includes a motor 32 being securely and conventionally mounted with a bracket in the housing member 18 and having a rotatable shaft 33 extended therefrom, and also includes a cam 34 being conventionally attached to the rotatable shaft 33 and being in contactable relationship with a top end of the piston 31, and further includes a power cord 35 being conventionally connected to the motor 32, and also includes a pair of power switches 36,37 being conventionally connected to the motor 32 and to the power cord 35 for the energizing of the motor 32. The means for oscillating the scoop member further includes a flange 38 being securely and conventionally disposed about the top end of the piston 31, and also includes a spring 40 being conventionally disposed about the piston 31 and being disposed between the bushing 29 and the flange 38 for biasing the piston 31 into contactable relationship with the cam 34. The power cord 35 extends through a hole 39 in the housing member 18 and is held in the hole 39 with a keeper 44 and is fastened with elastic band members 41,42 along the elongate shaft member 21. The power switches 36,37 are depressibly disposed in the bottom sides 25,27 of the extended grip portions 24,26.

In use, the user plugs the power cord 35 into an electrical outlet and depresses the power switches 36,37 to energize the motor 32 which causes the cam 34 to effectively move the piston 31 into intermittent contact with the vibratable shaft 28 thus causing the scoop member 11 to vibrate. The user places the blade member 16 along edges of the roofing material to be removed, and as the scoop member 11 vibrates, the blade member 16 loosens the roofing material from the building structure.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the roof-removing shovel apparatus. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A roof-removing shovel apparatus comprising:

a scoop member including a main wall having a bottom edge, and also including side and top walls attached to said main wall;

a blade member being attached along said bottom edge of said main wall of said scoop member;

a shaft assembly including a support member being attached to said top wall of said scoop member, said shaft assembly also including a housing member being extended from said support member, and also including an elongate shaft member being fastened to said housing member and extending outwardly therefrom, and further including housing supports being securely disposed in said support member;

a handle member being mounted to said shaft assembly for controlling said scoop member, said handle member including a tubular portion being securely mounted upon a top end of said elongate shaft member, and also including extended grip portions extending outwardly from said tubular portion with said handle member being generally T-shaped; and a means for oscillating said scoop member to effect chiseling of roof material.

2. A roof-removing shovel apparatus as described in claims 1, wherein each of said extended grip portions has an undulating bottom side for facilitating gripping of said extended grip portions.

3. A roof-removing shovel apparatus comprising:

a scoop member including a main wall having a bottom edge, and also including side and top walls attached to said main wall;

a blade member being attached along said bottom edge of said main wall of said scoop member;

a shaft assembly including a support member being attached to said top wall of said scoop member, said shaft assembly also including a housing member being extended from said support member, and also including an elongate shaft member being fastened to said housing member and extending outwardly therefrom, and further including housing supports being securely disposed in said support member;

a handle member being mounted to said shaft assembly for controlling said scoop member; and a means for oscillating said scoop member to effect chiseling of roof material, including a vibratable shaft being disposed in said support member and being securely attached to said top wall of said scoop member, and also including a bushing being securely disposed in said housing member, and further includes piston support member being supported by said bushing, and also including a piston being movably extended through said piston support member and being in contactable relationship to said vibratable shaft, and further including a motor being securely mounted with a bracket in said housing member and having a rotatable shaft extended therefrom, and also including a cam being attached to said rotatable shaft and being in contactable relationship with a top end of said piston to effect intermittent contact of said piston with said vibratable shaft thus causing vibration of said scoop member, and further including a power cord being connected to said motor, and also including at least one power switch being connected to said motor and to said power cord for the energizing of said motor.

4. A roof-removing shovel apparatus as described in claim 3, wherein said means for oscillating said scoop member further includes a flange being securely disposed about said top end of said piston, and also includes a spring being disposed about said piston and being disposed between said bushing and said flange for biasing said piston into contactable relationship with said cam.

5. A roof-fremoving shovel apparatus as described in claim 4, wherein said power cord extends through a hole in said housing member and is fastened with elastic band members along said elongate shaft member.

6. A roof-removing shovel apparatus as described in claim 5, wherein said at least one power switch includes a pair of said power switches being depressibly disposed in said bottom sides of said extended grip portions.

* * * * *